US010950966B2

(12) United States Patent
Baker

(10) Patent No.: US 10,950,966 B2
(45) Date of Patent: Mar. 16, 2021

(54) SAFETY STAB TECHNOLOGY

(71) Applicant: American Mine Research, Inc., Rocky Gap, VA (US)

(72) Inventor: William Douglas Baker, Bluefield, VA (US)

(73) Assignee: American Mine Research, Inc., Rocky Gap, VA (US)

( * ) Notice: Subject to any disclaimer, the term of this patent is extended or adjusted under 35 U.S.C. 154(b) by 0 days.

(21) Appl. No.: 16/663,995

(22) Filed: Oct. 25, 2019

(65) Prior Publication Data

US 2020/0136289 A1 Apr. 30, 2020

Related U.S. Application Data

(60) Provisional application No. 62/751,336, filed on Oct. 26, 2018.

(51) Int. Cl.
*H01R 13/15* (2006.01)

(52) U.S. Cl.
CPC ..... *H01R 13/15* (2013.01)

(58) Field of Classification Search
CPC ..... H01R 13/15
USPC ..... 439/825
See application file for complete search history.

(56) References Cited

U.S. PATENT DOCUMENTS 3,360,764 A 12/1967 Georges
3,923,366 A 12/1975 Olashaw
4,033,660 A 7/1977 Ericson et al.
4,176,905 A 12/1979 Marechal
4,416,499 A 11/1983 Frascatore et al.
4,845,593 A 7/1989 Brown et al.
5,035,646 A 7/1991 Ehrenfels et al.
5,154,626 A 10/1992 Watson
5,480,318 A * 1/1996 Garrison ..... H01R 13/20 439/102
6,113,436 A 9/2000 Kuwahara et al.
6,234,851 B1 5/2001 Phillips
6,309,231 B1 * 10/2001 Gordon ..... H01R 13/4538 439/140

(Continued)

FOREIGN PATENT DOCUMENTS

CN 105811145 A 7/2016
EP 0112258 B1 5/1987

(Continued)

*Primary Examiner* — Alexander Gilman
(74) *Attorney, Agent, or Firm* — New River Valley IP Law, P.C.; Michele L. Mayberry

(57) ABSTRACT

A stab (pin and sleeve) electrical connector with improved safety is described. The female (sleeve) connector exterior surface is coated or made from with a nonconductive insulating material. A pressure loaded insulator plug is disposed inside the female sleeve. An electrical connection is made when the male (pin) connector is inserted into the female sleeve. The male pin contacts the insulator plug inside the female sleeve, causing compression, and makes electrical contact with the uninsulated inside of the sleeve. As the male pin is removed, the pressure mechanism of the insulator plug pushes the plug out flush with the external insulated surface making the female sleeve touch safe. Therefore, embodiments provide a high level of safety for the pin and sleeve electrical connection method without adding large or troublesome moving parts.

18 Claims, 5 Drawing Sheets

(56) References Cited

U.S. PATENT DOCUMENTS 6,350,155 B1 * 2/2002 Mullinger-Bausch ..... H01R 35/04 439/675
6,464,511 B1 * 10/2002 Watanabe ..... H01R 13/2421 439/66
7,322,859 B2 * 1/2008 Evans ..... H01R 13/625 439/140
7,344,418 B2 * 3/2008 Xu ..... H01R 13/2421 439/700
7,794,252 B2 9/2010 Sauer et al.
8,408,946 B1 * 4/2013 Sochor ..... H01R 12/714 439/700
8,567,438 B2 10/2013 Tivelli
8,747,134 B2 * 6/2014 Schlogl ..... H01R 13/005 439/194
9,350,144 B2 5/2016 Graf
9,431,742 B2 * 8/2016 DiFonzo ..... H01R 13/17
9,437,952 B2 * 9/2016 Borkar ..... H01R 13/04
9,515,420 B2 * 12/2016 Daoura ..... H01R 13/642
9,831,596 B1 11/2017 Simas
9,887,489 B1 2/2018 Dietz et al.
2003/0176113 A1 * 9/2003 Sasaki ..... H01R 12/52 439/700
2004/0053539 A1 * 3/2004 Watanabe ..... H01R 12/714 439/700
2004/0077225 A1 * 4/2004 Chun-Fu ..... H01R 13/2471 439/700
2004/0161981 A1 * 8/2004 Matsui ..... H01R 13/2421 439/824
2006/0172613 A1 * 8/2006 Sasaki ..... H01R 13/2421 439/824
2010/0093206 A1 4/2010 Chuen
2016/0156140 A1 6/2016 Condo et al.

FOREIGN PATENT DOCUMENTS

EP 0570650 B1 5/1995
EP 1925060 B1 5/2016
WO 2000046881 A1 8/2000
WO 2018050767 A1 3/2018

* cited by examiner

SAFETY STAB TECHNOLOGY

CROSS-REFERENCE TO RELATED APPLICATIONS

This application relies on the disclosure of and claims priority to and the benefit of the filing date of U.S. Provisional Application No. 62/751,336, filed Oct. 26, 2018, the disclosure of which is hereby incorporated by reference herein in its entirety.

BACKGROUND OF THE INVENTION

Field of the Invention

The present invention is in the field of electrical connection devices. More particularly, embodiments of the invention relate to a stab (or pin and sleeve) electrical connector with improved safety. The stab electrical connector includes a sleeve with an internal insulator device which prevents access to the conductive portion of the sleeve when not in use.

Description of Related Art

The pin and sleeve electrical connection has been used for many years and is a dependable method of transferring power. With the advent of removable electric modules, safety has become a big concern. When a module is removed, there can be exposure to live high voltage electrical connections. Other methods of isolation exist. Doors, shutters, and curtains have been used. However, these systems can be bulky and large. They also may not work properly over time, or when installed in a dirty environment. There is a need for improved technology that overcomes these shortcomings.

SUMMARY OF THE INVENTION

Embodiments of the present invention provide improved safety to stab (pin and sleeve) electrical connection technology. According to embodiments, the female (sleeve) connector exterior surface is coated or made from one or more nonconductive insulating material. A pressure loaded insulator plug is disposed inside the female sleeve. An electrical connection is made when the male (pin) connector is inserted into the female sleeve. The male pin contacts the insulator plug inside the female sleeve, causing compression, and makes electrical contact with the uninsulated inside of the female sleeve. As the male pin is removed, the pressure mechanism of the insulator plug pushes the plug toward the external insulated surface of the female sleeve making the female sleeve touch safe. Therefore, embodiments provide a high level of safety for the pin and sleeve electrical connection method without adding large or troublesome moving parts.

BRIEF DESCRIPTION OF THE DRAWINGS

The accompanying drawings illustrate certain aspects of embodiments of the present invention, and should not be used to limit the invention. Together with the written description the drawings serve to explain certain principles of the invention.

DETAILED DESCRIPTION OF VARIOUS EMBODIMENTS OF THE INVENTION

Reference will now be made in detail to various exemplary embodiments of the invention. It is to be understood that the following discussion of exemplary embodiments is not intended as a limitation on the invention. Rather, the following discussion is provided to give the reader a more detailed understanding of certain aspects and features of the invention.

As used in the context of this specification, "conductive", "conducting" and other grammatical variations are intended to mean being capable of transferring (conducting) electricity, while "non-conductive", "non-conducting" and other grammatical variations are intended to mean not being capable of transferring (conducting) electricity. "Insulative", "insulator", "insulating", and other grammatical variations are used interchangeably with "non-conductive", "non-conducting", and so on.

Figure 1:
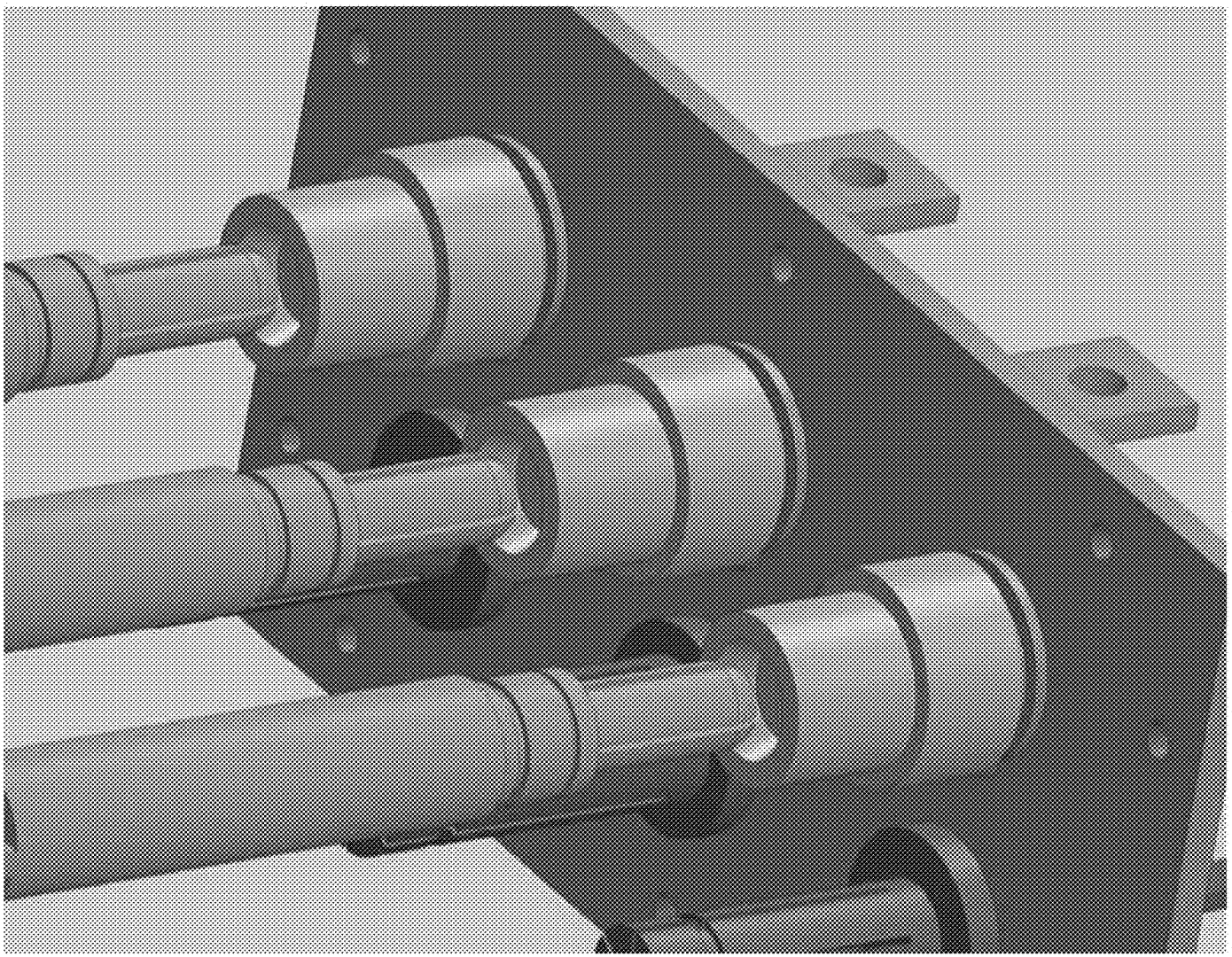
FIG. 1 is a diagram showing a safety stab electrical connector according to an embodiment.

Turning now to the figures, FIG. 1 shows an embodiment of a safety stab electrical connector. The connector includes an array of female connectors (i.e. sleeves or sockets) mounted on a plate or board, which can be nonconductive and/or coated with one or more nonconductive material. As shown, three sleeve connectors are aligned in a row and positioned to receive three male (i.e. pin) connectors. The exterior surface or outer portion of the sleeve connectors mounted on the plate or board comprises or is coated with a nonconductive material. In this case, the outer nonconductive portion of the sleeve connectors is disposed as a pair of sockets or cylinders, with one narrower socket concentrically disposed within a wider socket which is mounted on the plate. In embodiments, the outer nonconductive portion of the sleeve can comprise a single piece configuration, or can comprise a plurality of parts.

Figure 2:
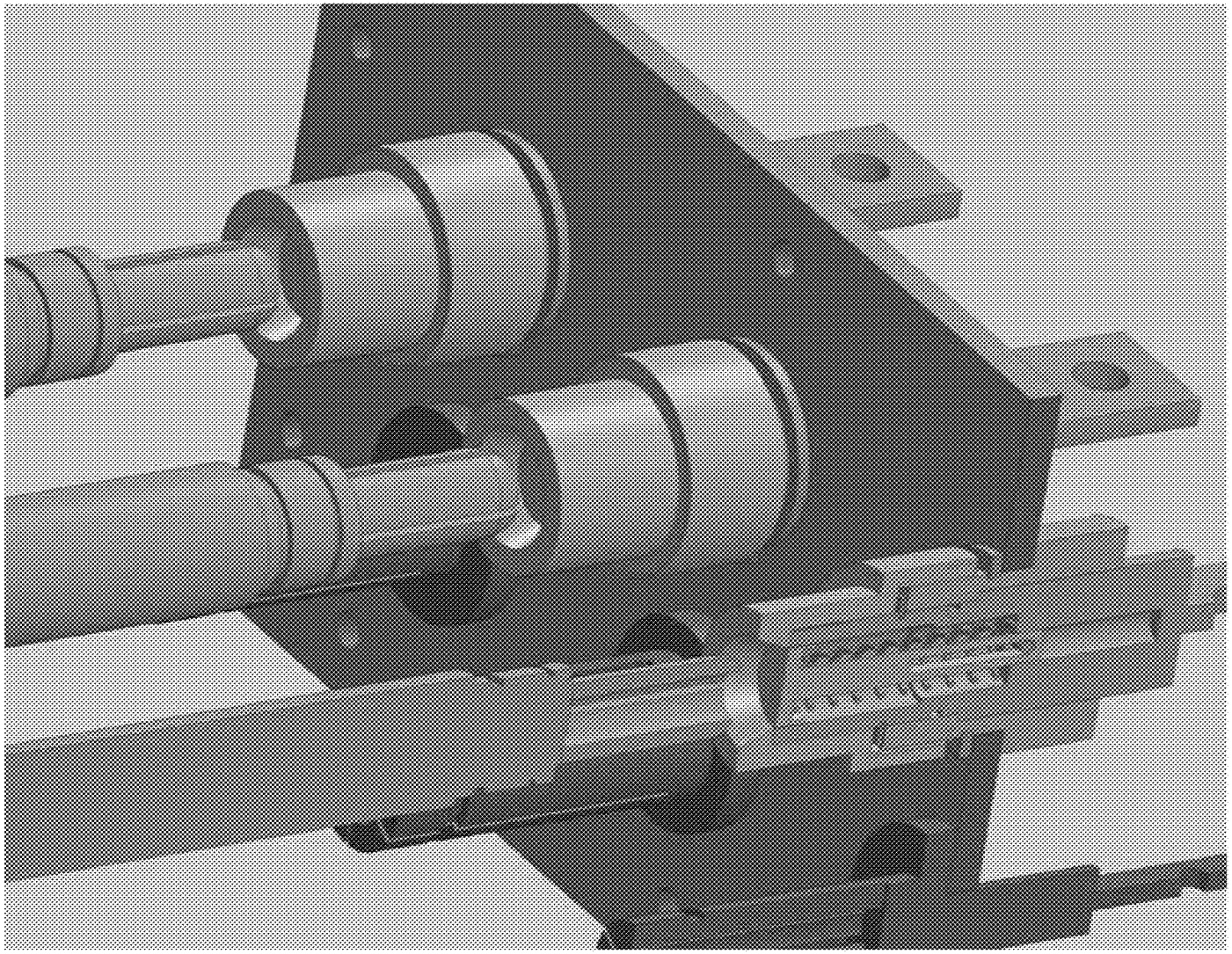
FIG. 2 is a diagram showing a cross-section of a safety stab electrical connector according to an embodiment.
Figure 3:
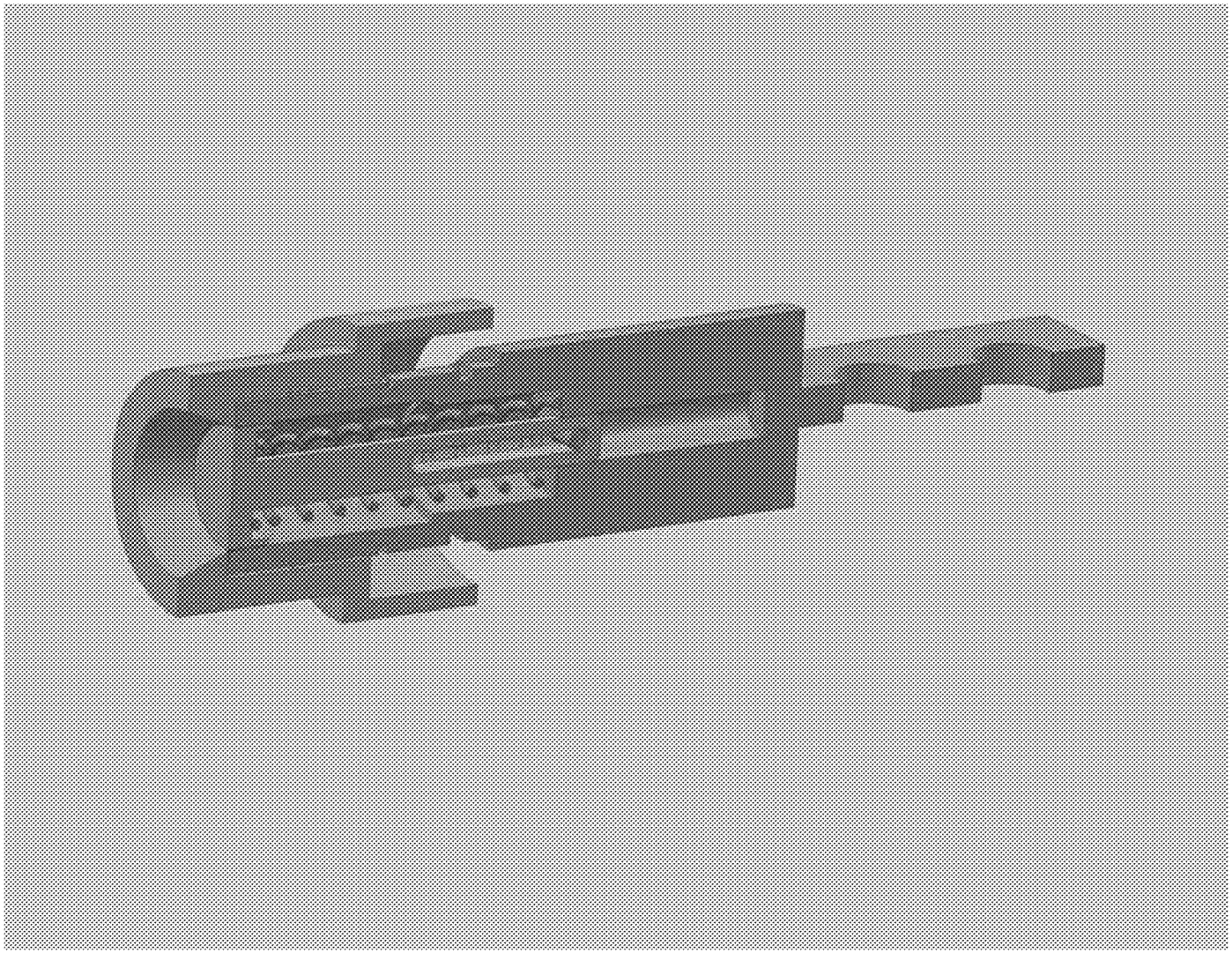
FIG. 3 is a diagram showing a cross-section of a sleeve of a safety stab electrical connector according to an embodiment.
Figure 4:
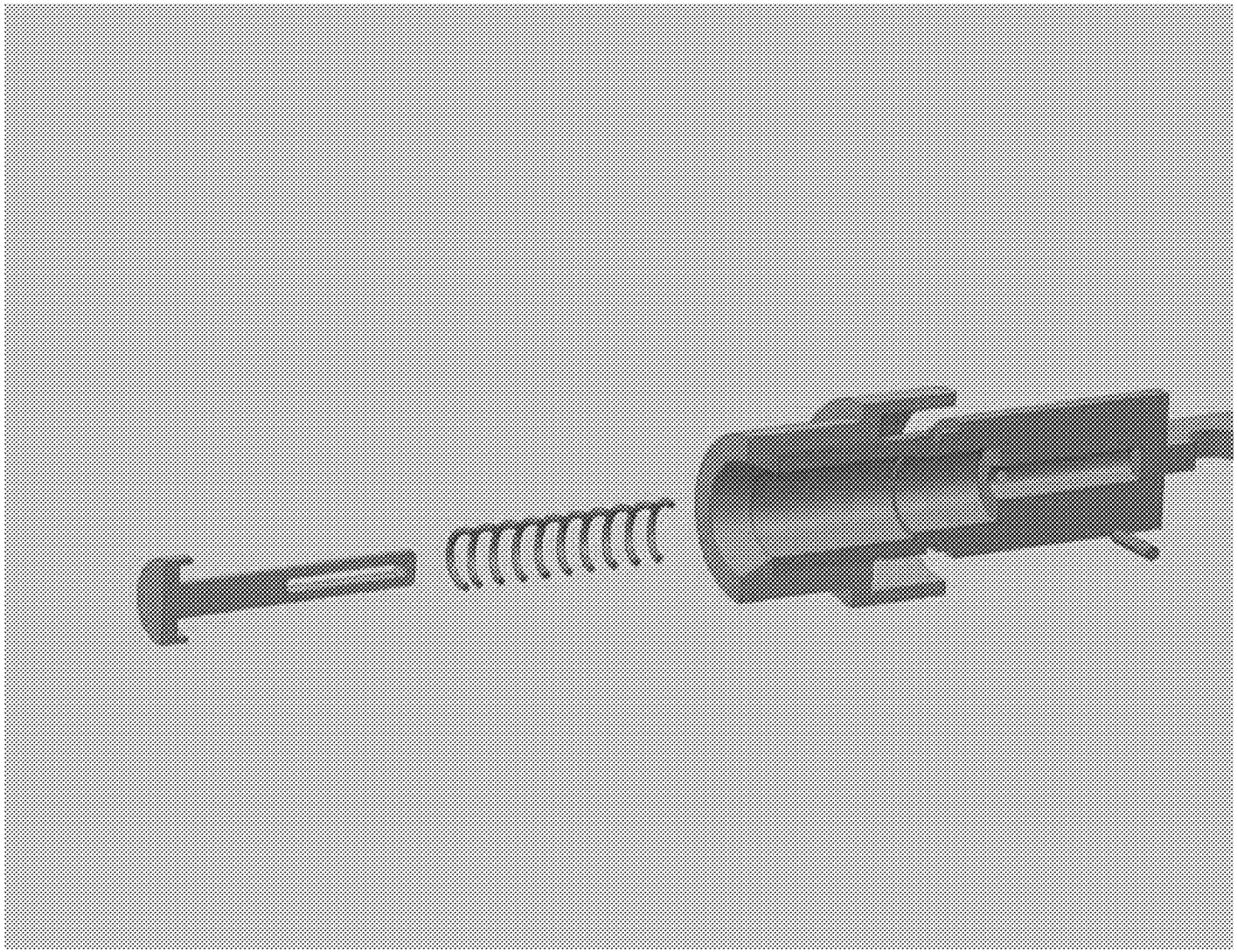
FIG. 4 is a diagram showing an exploded view of the sleeve of FIG. 3 to highlight the internal components of the sleeve, according to an embodiment.

An upper/outer surface of a non-conductive plug is shown in the interior of each female sleeve/connector, and is shown more clearly in FIGS. 2 and 3 which provide a cross-section of one of the sleeves. FIGS. 2 and 3 show that the sleeve includes a conductive socket which hosts the non-conductive or insulator plug, which in this case is shown in a position extended toward the opening of the socket. The plug is extended by way of a pressure mechanism which can be a spring or any equivalent pressure mechanism that pushes the plug toward the opening. In embodiments, the plug can be held in an extended position by structure that prevents further movement of the plug, such as by having a portion of the outer non-conductive portion of the socket overlap with the upper surface of the plug. FIG. 3 also shows that the insulator plug can alternatively or in addition comprise a shaft portion extending within the conductive sleeve, and a posterior portion of the shaft portion can comprise a slot. As shown in FIG. 3, insulator plug is retained in conductive socket by a small connecting pin or rod. Thus, when the spring is extended or allowed to relax, the top of the insulator plug is pushed into a position toward the opening of the socket in a manner that allows the plug and the non-conductive outer portion of the sleeve connector together to prevent access to conductive portion of the interior of the sleeve, as shown. Further, insulator plug is prevented from being removed from the socket when the end of the slot reaches the connecting rod and/or when the plug otherwise is prevented from moving further by other structure, such as the non-conductive portion overlapping with the plug. FIG. 4 shows the plug, spring, and pin/rod disconnected from the conductive socket of the sleeve, such that the insulator plug, spring, and connecting rod/pin are shown in a disassembled state.

Figure 5:
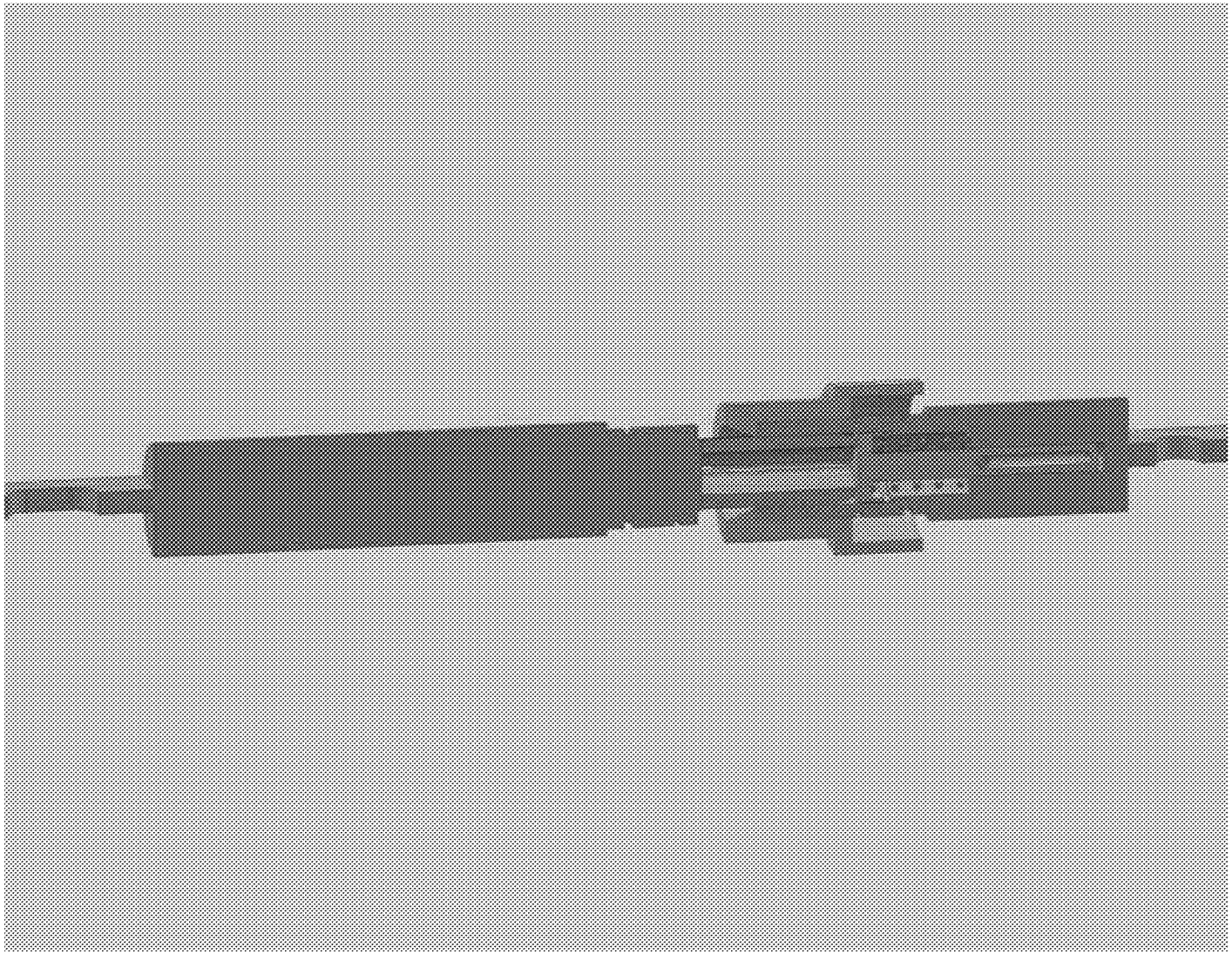
FIG. 5 is a diagram showing a cross-section of a pin engaged in a sleeve of a safety stab electrical connector according to an embodiment.

FIG. 5 shows that when a conductive male pin connector is inserted into an interior of the female sleeve connector, it pushes against the insulator plug causing compression of the pressure mechanism (e.g., spring) inside the sleeve, allowing contact of the conductive male pin connector with the interior of the conductive portion of the socket, such that an electrical connection is established between the male and female sides of the connector. The conductive male pin connector can fit into an interior of the conductive socket by way of a clearance fit, interference fit, compression fit (or any type fit suitable for electrical engagement and/or contact), which provides for slideable engagement between these two components. Also, in the configuration shown in FIG. 5, a second cylindrical portion is disposed at the posterior end of the conductive socket and is dimensioned to receive the shaft of insulator plug during advancement of male pin connector and compression of pressure mechanism, by way of for example clearance fit. Insulator plug is capable of being pushed inside the sleeve up to the point that the shaft portion of the insulator plug reaches/contacts the end of the second cylindrical portion of the socket and/or the end of the slot of the shaft portion of the insulator plug reaches/contact the connecting rod/pin.

The conductive portions of the safety stab electrical connector can be made of any conductive material, including metals such as steel, Al, Ni, Cr, Cu, Co, Au, Ag, Mg, Cd, Pb, Pt, Ti, Zn, Fe, Nb, Ta, Mo, W, or an alloy comprising one or more of these metals. The non-conductive or insulator portions can be made of or be coated with a non-conductive polymer or plastic material such as a polyolefin, polyester, nylon, vinyl, polyvinyl, acrylic, polyacrylic, polycarbonate, polystyrene, or polyurethane.

The safety stab connector can be used in any application requiring an electrical connection where safety is paramount. These would include any high voltage electrical connection with which personnel can potentially come in contact. The safety stab connector is particularly advantageous as it includes no bulky parts and can be used in dirty environments such as in mining and manufacturing. For example, the safety stab connectors of embodiments of the invention can be used with removable contactor drawers, such as those of U.S. Pat. No. 9,350,144, and either the female or male side of the connector can provide and/or receive electrical power.

The present invention has been described with reference to particular embodiments having various features. In light of the disclosure provided above, it will be apparent to those skilled in the art that various modifications and variations can be made in the practice of the present invention without departing from the scope or spirit of the invention. One skilled in the art will recognize that the disclosed features may be used singularly, in any combination, or omitted based on the requirements and specifications of a given application or design. When an embodiment refers to "comprising" certain features, it is to be understood that the embodiments can alternatively "consist of" or "consist essentially of" any one or more of the features. Other embodiments of the invention will be apparent to those skilled in the art from consideration of the specification and practice of the invention.

It is noted in particular that where a range of values is provided in this specification, each value between the upper and lower limits of that range is also specifically disclosed. The upper and lower limits of these smaller ranges may independently be included or excluded in the range as well. The singular forms "a," "an," and "the" include plural referents unless the context clearly dictates otherwise. It is intended that the specification and examples be considered as exemplary in nature and that variations that do not depart from the essence of the invention fall within the scope of the invention. Further, all of the references cited in this disclosure are each individually incorporated by reference herein in their entireties and as such are intended to provide an efficient way of supplementing the enabling disclosure of this invention as well as provide background detailing the level of ordinary skill in the art.

The invention claimed is:

1. A sleeve component of a stab connector, the sleeve component comprising:

one or more non-conductive cylinder;

a conductive cylinder disposed inside of and in communication with the non-conductive cylinder and comprising an anterior portion and a posterior portion, wherein the posterior portion comprises a slot;

a non-conductive plug in operable connection with a pressure mechanism, which non-conductive plug is disposed inside and is capable of slideable engagement with an interior of the conductive cylinder as a result of compression or extension of the pressure mechanism.

2. The sleeve component of claim 1, wherein the non-conductive plug and pressure mechanism are capable of being actuated in a first position which blocks access to the interior of the conductive cylinder and a second position which allows access to the interior of the conductive cylinder.

3. The sleeve component of claim 1, wherein the anterior portion of the conductive cylinder is dimensioned to receive a pin of a stab connector, optionally correspondingly dimensioned, and has a wider width or diameter than a width of the posterior portion.

4. The sleeve component of claim 1, wherein the anterior portion of the conductive cylinder has a wider width or diameter than a width of the posterior portion.

5. The sleeve component of claim 1, wherein the anterior portion of the conductive cylinder is dimensioned to accommodate an anterior portion of the non-conductive plug which allows slideable engagement between each anterior portion, optionally by way of a clearance fit.

6. The sleeve component of claim 1, wherein the posterior portion of the conductive cylinder is dimensioned to accommodate a posterior portion of the non-conductive plug which allows slideable engagement between each posterior portion, optionally by way of a clearance fit.

7. The sleeve component of claim 1, wherein the pressure mechanism is a spring.

8. The sleeve component of claim 1, wherein the posterior portion of the conductive cylinder comprises a connecting rod.

9. The sleeve component of claim 8, wherein the connecting rod is disposed within the slot of the non-conductive plug.

10. The sleeve component of claim 8, wherein the connecting rod is disposed in a manner such that it is capable of limiting movement of the non-conductive plug.

11. The sleeve component of claim 1, wherein the non-conductive plug comprises or is coated with a non-conductive polymer or plastic material.

12. The sleeve component of claim 1, wherein the conductive cylinder comprises or is coated with a metal or metal alloy.

13. The sleeve component of claim 11, wherein the non-conductive polymer or plastic material comprises a polyolefin, polyester, nylon, vinyl, polyvinyl, acrylic, polyacrylic, polycarbonate, polystyrene, or polyurethane.

14. The sleeve component of claim 12, wherein the metal or metal alloy comprises steel, Al, Ni, Cr, Cu, Co, Au, Ag, Mg, Cd, Pb, Pt, Ti, Zn, Fe, Nb, Ta, Mo, W.

15. A stab connector comprising one or more sleeve component of claim 1.

16. The stab connector of claim 15, wherein one or more of the sleeve components is mounted on a plate or board, optionally wherein the plate or board is non-conductive.

17. The stab connector of claim 15, wherein the interior of the conductive cylinder is dimensioned to allow slideable engagement with a conductive pin inserted therein.

18. The stab connector of claim 15, further comprising one or more conductive pins capable of insertion into the interior of the conductive cylinder, optionally by way of a clearance fit which allows slideable engagement between the conductive cylinder and the conductive pin inserted therein.

* * * * *